US006409019B1

(12) United States Patent
Hornsby et al.

(10) Patent No.: US 6,409,019 B1
(45) Date of Patent: Jun. 25, 2002

(54) THREE DIMENSIONAL PACKAGING

(75) Inventors: James R. Hornsby, St. Louis; Marcellus R. Benson, Chesterfield, both of MO (US)

(73) Assignee: Trendmasters, Inc., St. Louis, MO (US)

( * ) Notice: Subject to any disclaimer, the term of this patent is extended or adjusted under 35 U.S.C. 154(b) by 0 days.

(21) Appl. No.: 09/466,142

(22) Filed: Dec. 17, 1999

(51) Int. Cl.[7] ..... B65D 73/00

(52) U.S. Cl. ..... 206/471; 206/458; 206/483; 206/806

(58) Field of Search ..... 206/461–467, 206/469–471, 457, 458, 459.5, 806, 483, 278, 281, 292; 53/471, 473, 474

(56) References Cited

U.S. PATENT DOCUMENTS 3,032,926 A * 5/1962 Lang ..... 206/461
3,970,194 A * 7/1976 Iten ..... 206/469
4,453,629 A * 6/1984 Goldberg ..... 206/471
4,485,921 A * 12/1984 Geller ..... 206/471
D278,795 S 5/1985 Fireman
4,653,642 A 3/1987 Hakun et al.
D315,871 S 4/1991 Whitebread
D320,934 S 10/1991 Cross et al.
5,188,222 A * 2/1993 Pierce ..... 206/471
D353,092 S 12/1994 Green
5,718,335 A * 2/1998 Boudreaux ..... 206/461
5,845,778 A * 12/1998 Hickey, Jr. ..... 206/461
5,865,013 A * 2/1999 Jackson ..... 206/471
5,890,594 A 4/1999 Hansen et al.
5,896,991 A * 4/1999 Hippely et al. ..... 206/467
6,152,298 A * 11/2000 Dods ..... 206/471

OTHER PUBLICATIONS

G.I. Joe® Package, Copyright 1998 (Photos attached as exhibits 1–5).

* cited by examiner

*Primary Examiner*—Luan K. Bui
(74) *Attorney, Agent, or Firm*—Dorsey & Whitney LLP

(57) ABSTRACT

The present invention provides a blister for a blister type package, and a blister package, wherein the blister is generally transparent and has two separate pockets. The first pocket receives and contains a product to be sold. The second pocket has an irregularly shaped front surface and contains a figural item preferably related to the product. The irregularly shaped front surface of the second pocket substantially conforms to the figural item, thereby creating the appearance that the second pocket contains an article associated with the product.

3 Claims, 3 Drawing Sheets

THREE DIMENSIONAL PACKAGING

BACKGROUND

The present invention relates generally to packages, receptacles and packaging. More particularly, the present invention relates to blister packaging for storing, containing, shipping and attractively displaying merchandise.

Packaging is known in a myriad of forms, likely as numerous as items or objects to be carried, contained, wrapped, enclosed or otherwise "packaged." A vast variety of material may be used to create packages, ranging from paperboard to plastic, the latter of which may be molded or thermoformed to provide cavities or nests for receiving products. Plastics are well-suited for use in the packaging industry because they provide protection for contents of packages, they may be transparent and they are relatively inexpensive, allowing for protection and display or viewing of products and/or information related to products at a reasonable cost.

Most consumer goods, particularly children's toys, are sold in a highly competitive marketplace. These products must compete with each other for the attention of prospective purchasers. Many items, particularly relatively small items, can be "lost" on the retailers' shelves. One highly effective method of differentiating a product, thereby attracting more consumer attention, is to use packaging to augment the product attractiveness or to depict or represent articles related to the product or the product's use or environment of use. For example, packages having a three-dimensional shape may attract the attention of a customer who is looking for a particular type of gift and may help the customer visualize the environment in which the product will be used. Three-dimensional packages are particularly useful in attracting the attention of children because they can better sense the shape and feel of the contents. The three-dimensional portions of packages may contain product related items, and these items should be displayed within the packaging so they cannot be separated from the product during shipment or removed by customers who do not purchase the product. Preferably, such packaging should provide a three-dimensional display and should not distort features of the product or related display, yet should protect the product and display.

U.S. Pat. No. 4,653,642 (Hakun et al.) discloses a display package for a mask, such as a stocking, ski-type or facial mask. The package includes a frame with a header for holding the mask, and cooperating inner and outer shell members. The inner shell member includes a forwardly projecting area or surface substantially conforming to the shape of a face, thereby providing for realistic support and display of the mask. The outer shell member, which is transparent for viewing the mask, nests with and overlies the inner shell member. The shell members thus each include a forwardly projecting area substantially conforming to the shape of a face, and to each other. In use, the mask is disposed between the inner and outer shell members, the shell members are inserted between the front and rear panels of the frame members and the frame members are stapled. The Hakun et al. package is designed for a single specific purpose, namely, containing and displaying face masks. It does not disclose or suggest providing a blister type package with at least two discrete pockets, wherein one pocket is configured to contain the product to be sold and the other is configured to present, contain or appear to contain an article or display related to the product to be sold.

Accordingly, there is a need for a blister package having at least two discrete pockets, one of which contains the product to be sold and the other which contains an item associated with the product. There is also a need for a blister package in which the pocket containing the associated item has a three-dimensional configuration that does not distort the appearance of the item and that allows purchasers to tactically experience the product.

SUMMARY

The present invention provides a "blister" package which largely addresses the above-articulated need. In one embodiment, the package includes a generally transparent, plastic blister cover having two separate pockets, a first pocket for containing a product to be sold and a second, three-dimensional pocket with an irregularly shaped front surface for containing a three-dimensional "figural item" generally related to the product to be sold.

As used herein, the terms "blister," "blister pack(s)," "blister package," "blister card" and like terms are intended to encompass packages (which also may be referred to as packaging, containers, receptacles, cartons or enclosures) for receiving a product to be displayed and/or sold, and packaging methods and methods of making packaging, wherein a plastic or other suitable material, at least a portion of which typically may be transparent or provide a window, is formed or deformed to include at least one dish, pocket, cavity or the like for receiving, containing and usually generally conforming to a product and/or product related material, and wherein the plastic or other material may be connected to a like or unlike material, which material may be referred to as a card or backer board, to contain, support and/or display a product to be sold and/or product related material.

As used herein, the terms "figural item," "figural object" or "figural element" and the like are intended to mean a material shaped, formed, configured and/or graphically decorated or designed to represent, illustrate or depict a creature (e.g., human, animal, imaginary or whimsical, etc.), form, structure, environment or location (e.g., woods, jungle, mountains, etc.). The figural item may be a portion of a backer board deformed, built up, relieved or otherwise treated.

In one embodiment, the blister package of the present invention comprises a backing or support board and a plastic blister cover carried on at least one side of the board, wherein the blister has at least two separate pockets. One of the pockets contains the product being sold. The second pocket has a three-dimensional configuration with an irregularly shaped front surface and houses a figural item. In some embodiments, the figural item relates generally to the product being sold and comprises a sheet of plastic or paper at least a portion of which is formed to substantially conform to the front surface of the second pocket and which carries graphics and/or indicia, whereby the graphics and/or indicia are not distorted and whereby the package gives the appearance that the second pocket contains a physical article associated with the product.

The present invention encompasses a method for packaging a product comprising forming a figural item having a three-dimensional surface and carrying graphics, forming a cover having a first pocket and a second pocket, the first pocket generally conforming to the shape of at least a portion of the product and the second pocket having a front surface generally congruent to the three-dimensional surface of the figural item, inserting the product into the first pocket and inserting the figural item into the second pocket, whereby the front surface of the second pocket does not distort the graphics and whereby the package gives the appearance that the second pocket contains an article associated with the product. A suitable backer board may be provided, and the cover and backer board may be connected to compete or seal the package.

In some embodiments, the figural item may be used for product environment or display purposes after it has been removed from the blister package, and may incorporate a base or an easel-type, foldout support structure.

It should be appreciated that features of any of the embodiments of the present invention may be selectively combined to adapt the package for a variety of products, information or items related to the products, and a variety of point-of-sale situations.

Other features and advantages of the package components, package, packaging method and method of providing or making packaging of the present invention will become more fully apparent and understood with reference to the following description and appended drawings and claims:

DETAILED DESCRIPTION

The accompanying figures and this description depict and describe embodiments of the package component, package and packaging method of the present invention, including a three-dimensional blister embodiment, and features and components thereof. Any suitable fastening, mounting, attaching or connecting device or method may be used to couple or join components of the present invention to form the package as a whole and, unless specifically described otherwise, may encompass fasteners such as threaded connectors, snaps or snap fitting, clamps, rivets, pins and the like. Components may also be connected by adhesives, glues, heating, welding, ultrasonic welding, friction fitting or deformation, if appropriate. Unless specifically otherwise disclosed or taught, materials for making components of the present invention may be selected from appropriate materials such as metal, metallic alloys, natural and manmade fibers, vinyls, plastics and the like, and appropriate manufacturing or production methods, including casting, thermoforming, pressing, extruding, molding and machining, may be used.

Generally, references to front and back, right and left, top and bottom and upper and lower are intended for convenience of description, not to limit the present invention or its components to any one positional or spacial orientation.

Figure 1:
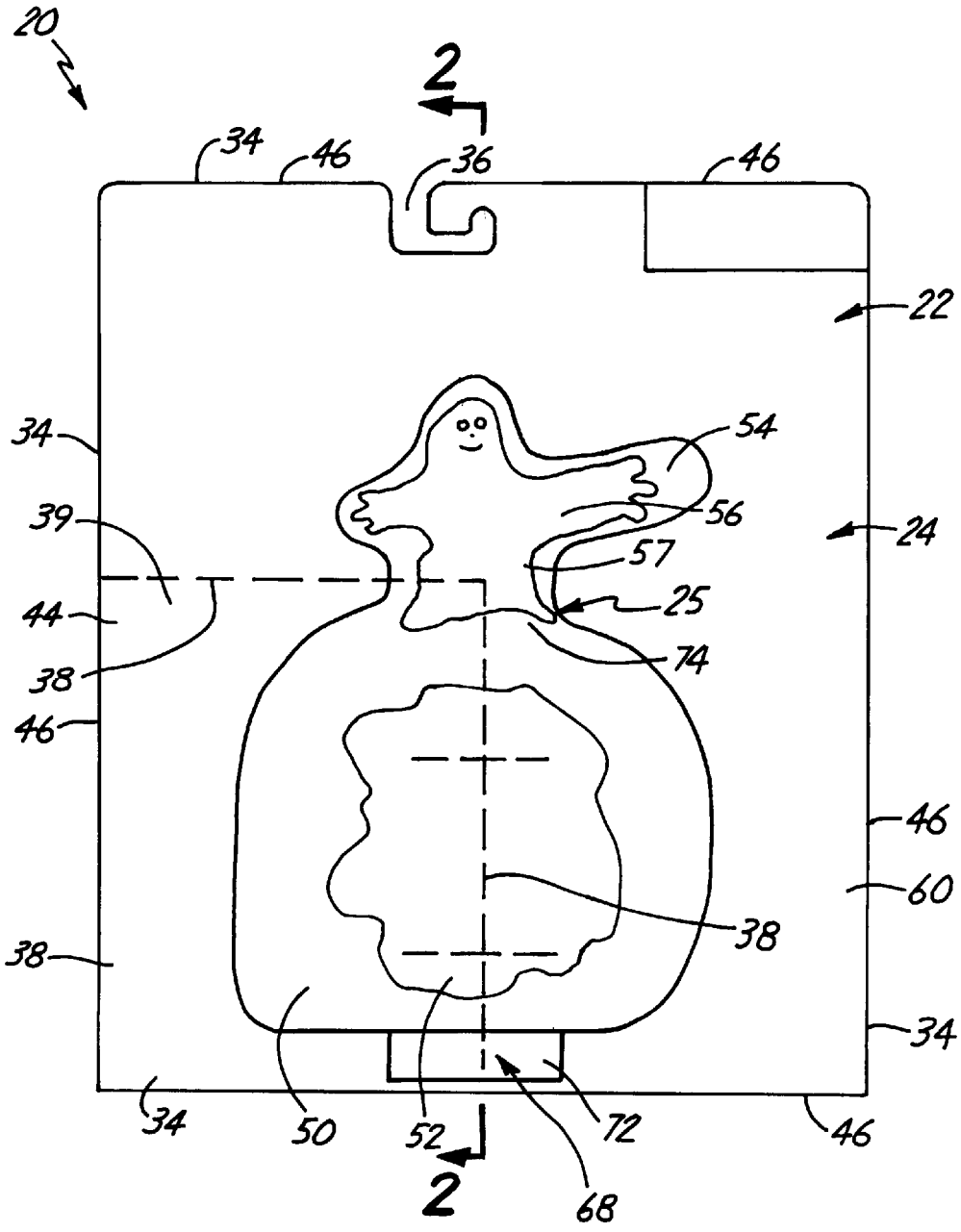
FIG. 1 is an isometric view of one embodiment of a package in accordance with the present invention.
Figure 2:
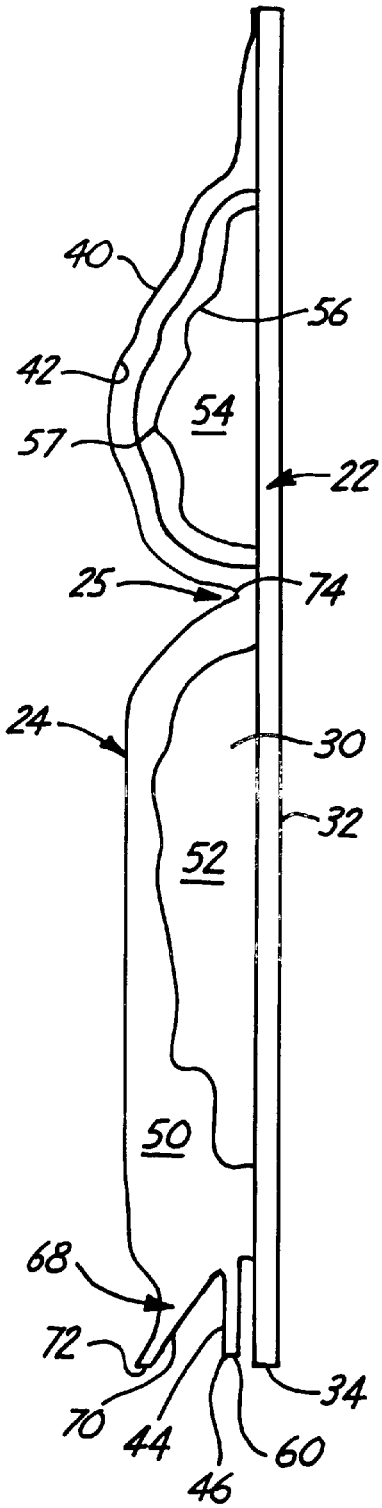
FIG. 2 is a sectional view of the embodiment depicted in FIG. 1, as taken along the line 2—2.

One embodiment of a blister package 20 in accordance with the present invention is shown in FIGS. 1–2 as it might appear to a consumer at a retail store. For display purposes at a point of sale, the package 20 may be configured to stand on a shelf, hang from a rack or be stacked. The depicted blister package 20 generally comprises a backer board 22 and a front panel 24. The backer board 22 comprises a planar front surface 30, a planar back surface 32, a plurality of edges 34 that intersect to give the board a geometric shape, and a hanging aperture 36 located on or near one of the edges 34. The front panel 24 comprises an external surface 40, an opposite internal surface 42, a rim area 44 adapted to engage the front surface 30 of the backer board 22, and a plurality of edges 46, which in some embodiments have substantially the same geometric shape as the backer board 22, i.e., the shape of the board as formed by the intersecting edges 34. The backer board 22 and the front panel 24 in this embodiment cooperate to close or complete a first pocket or blister 50 that is shaped and sized to receive a product to be sold 52, and a second pocket or blister 54 that is shaped and sized to receive a figural item 56.

The backer board 22 is typically generally flat, and may be made from one or more pieces, sheets and/or layers of generally planar or flat suitable material, such as plastic, cardboard, paper, or the like. Its front surface 30 and/or back surface 32 should be capable of receiving a graphical design, instructions, a product description, a trademark, a bar code, or other indicia or printed material. Near or on at least one of the edges 34, the backer board 22 may include one or more hanging apertures 36 having a "coat hanger" shape. This "coat hanger" shape aids in suspending the container 20 from typical mounting rods or pins found at points of sale (not shown). It is understood, however, that each hanging aperture 36 may also be formed as a die cut hole or slot. In some embodiments, the backer board 22 may comprise an easy opening feature in the form of a pattern 38 of weakness, formed, for example, by a series of perforations or a score line(s), in some embodiments arranged to form one or more flaps. This may be advantageous because users can more easily form an opening or openings through which they can remove the product 52 and/or the figural item 56. In some embodiments, similar lines of weakness (shown in phantom at 38') may be used to form a foldably deployable flap or wing 39 (in phantom) for supporting the package in a selected position.

The front panel 24 in one embodiment comprises a formable or moldable polymeric material that may be optically transparent, opaque, totally non-transparent, or exhibit some degree of transparency therebetween. The level of transparency may be consistent across the area of the panel 24, or it may be varied in regions. Transparent front panels 22 are particularly desirable for embodiments used to package children's toys and the like because potential purchasers may view the product 30 to be sold without opening the packaging 20. Opaque front panels 22 may be desirable for embodiments used to store items that can be damaged by exposure to light. Combinations of transparent, opaque or non-transparent regions or areas may be used to enhance the display and/or protection of selected products. For example, the first and second pockets 50, 54 may include a transparent region through which a potential buyer may see the product or a portion thereof, and/or the figural item or a portion thereof, and the remainder of the front panel may be opaque, colored, carry a graphic design(s) or exhibit a combination of these attributes.

In the process or method of making a package in accordance with the present invention, the front panel 24 typically begins as a generally flat sheet of material, for example, a clear polymeric material. In this instance, this sheet of material is preheated in an oven to a temperature somewhat below its melting point. The preheated sheet is then removed the oven, placed over a mold, and pulled or pushed against the mold's surface using vacuum, air, and/or mechanical pressure. Because the mold is usually at a relatively cool temperature, the polymeric sheet sets upon contact into a configuration that generally conforms to the shape of the mold.

In one embodiment, the forming or thermomolding process results in a front panel 24 having at least two structures or cavities, one or both of which may be three-dimensional, projecting from the plane of a generally flat, and generally surrounding, rim region 44. One of the cavities is then occupied by at least one product 52. The products 52 may be fed directly from the output end of an product producing machine, such as an injection molding machine, or from the output of any machine which produces products suitable for marketing in blister packs. Next, the figural item 56 is inserted or placed into the remaining cavity 54. There may be additional filling stations for both the product 52 and figural item 56 depending on the relative speed of the machines that thermoformed the front panel 24 and that fill the blisters. Also, the order of the filling of the pockets 50, 54 may be varied.

After the filling process, the backer board 22 may be framed by a suitable adhesive material 60, such as an approximately one-quarter inch strip of glue or double-sided tape, and secured to the thermoformed front panel 24. The adhesive material 60 should be selected to hold the front panel 24 and backer board 22 together with sufficient force so that they will not separate during shipment and display. Other securing methods (e.g., methods appropriate for the package material, sonic welding, mechanical fasteners, etc.) may be used alone or in conjunction with an adhesive. In the embodiment depicted in FIGS. 1 and 2, together, when attached to each other, the backer board 22 and the front panel 24 form a substantially sealed package including two pockets or blisters 50, 54, one containing the product 52 and the other containing the figural item 56, respectively.

Figure 3:
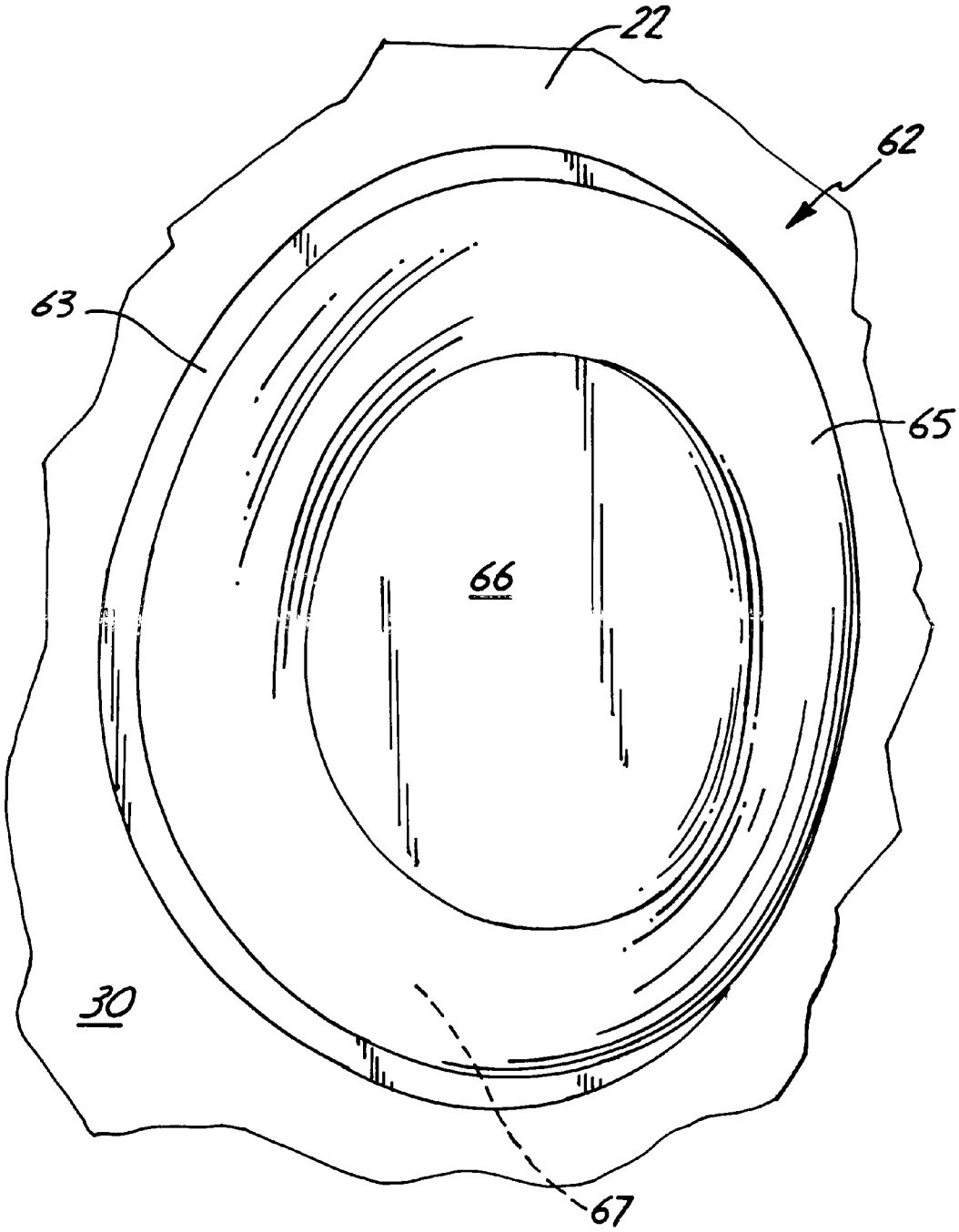
FIG. 3 is an isometric view of a nest for use with the embodiment in FIGS. 1–2.

The first pocket 50 may be located at or near the bottom of the package 20, and may be sized and shaped so that it can receive a product to be sold 52. In some embodiments, the first pocket 50 is solely defined by the backer board 22 and the front panel 24. In other embodiments, the first pocket 50 can contain a nest 62 that is located adjacent to the backer board 22 and that may be made from cardboard, paper, foam, plastic, or other suitable material. One such nest 62 is depicted in FIG. 3. In the depicted embodiment, the nest 62 comprises a single-piece body with a generally flat rim region 63 designed to engage or be seated on the front surface 30 of the backer board 22 and a raised generally central portion 65, that includes a depression or cavity 66 for receiving a product 52. The raised central portion 65 provides an air space 67 located between the cavity 66 and the backer board 22. Generally, the nest 62 should have a shape and size that generally compliment or are congruent with the shape and size of the first pocket 50, and the cavity 66 should have a shape and size that generally compliments a product 52. Packaging using embodiments of nest 62 are desirable because the nest 62 helps holds a product 52 in a fixed position and orientation within the first pocket 50, which helps to prevent the product from being jostled against the sides of the first pocket 50 during transit. In addition, the space 67 acts as a crumple zone or bumper that cushions a product 52 against an impact from another object.

Referring again to FIGS. 1 and 2, the first pocket 50 may also contain one or more bosses 68, which, as depicted, may project downwardly from its lowermost side. The boss 68 in the depicted embodiment has a flat surface 70 that forms an angle of between about ten and forty-five degrees with the backer board 22, and a lowermost edge 72 that is generally parallel with one of the edges 34 of the backer board 22. The boss 68 cooperates with the backer board 22 to form a tripod-like base on which the package 20 can rest in a generally upright position. This allows a retailer to display the package 20 on a shelf, counter, or other flat surface without any additional support.

In one embodiment of the present invention, the figural item 56 may be a sheet of plastic, paper, metal or other formable material that has been formed, at least partially, into a three-dimensional shape. The figural item 56 comprises a three-dimensional outer, presentation surface 57, and may have a generally flat rim (not shown). A selected graphic, indicium, design, color scheme or other image may be formed in or printed on the presentation surface 57. The three-dimensional presentation surface 57 and the selected graphic are advantageous because, for example, they create the illusion that the second pocket 54 contains a three-dimensional physical article, and/or they create an attention getting display.

The three-dimensional surface 57 and graphics of the figural item 56 preferably may be associated or related in some way with the product 52 being displayed or contained in the first pocket 50. For example, the figural item 56 could be a depiction of a profile or an enlargement of a portion of the product 52; it could depict a background scene similar to or representing one in which the product 52 is used or drawn from; or, it may provide a tie-in with an advertisement or a television show. In some embodiments, the figural item 56 may be an article or accessory for use with the product 52. This association or relatedness is desirable because the figural item 56 will help draw a potential purchaser's attention to the product 52. In addition, in packaging embodiments wherein the product 52 is housed in an opaque pocket, housing a figural item 56 in a transparent blister or pocket, or a blister or pocket with a transparent portion or window, can help the customer to visualize the product 52 and/or its use. Figural items 56 that are not associated with the product 52 in the above-described manner are also within the scope of the present invention. For example, the figural element 56 may depict another product or it may be a display designed to attract attention (e.g., a kinetic or moving display, a colorful display, etc.).

In some embodiments, the figural item 56 may include a hole or a tab (not shown) so that a user may mount the figural item 56 on a wall or the like after removing it from the packaging 20. Other embodiments of the figural item 56 may include a foldout base or easel-type backing (not shown) that can be used to stand the figural item 56 on a flat surface. These embodiments may be advantageous because the user could then use the figural item 56 to display or accentuate the product 52 or features thereof. Although the figural item 56 has been described as a sheet material that has been formed into a three-dimensional surface, other figural items are within the scope of the present invention. This includes, without being limited to, figural items made from injection molding, blow molding, or other forming processes.

The second pocket 54 may be located above the first pocket 50, as depicted, closer to the hanging aperture 36, but it should be appreciated that the pockets 50, 54 may be arranged in any orientation with respect to each other, and that more than two pockets may be used. The second pocket 54 has a textured or contoured interior surface 42 that generally or, in some embodiments, substantially, conforms to and is designed to receive the three-dimensional surface 57 of the figural item 56. That is, the interior surface 42 has generally the same shape as the figural item 56, but is slightly larger in size. The outer surface 40 of the second pocket 54 also has a texture or contour that generally conforms to the three-dimensional surface 57 of the figural item 56. These textured three-dimensional surfaces 40 and 42 are advantageous because they do not distort the three-dimensional surface 57 or the indicia or design the figural item 56 may carry. As a result, in some embodiments, it appears as if the second pocket 54 contains a physical article. In other embodiments, the second pocket 54 and the figural item 56 may provide a three-dimensional representation of the product in use or the setting in which the product may be used.

In some embodiments, the rim region 44 may be expanded, i.e., the front panel 24 may have generally flat regions around, adjacent to or between the pockets 50, 54. For example, in some embodiments, the second pocket 54 may be completely separate from the first pocket 50 in that the portion 25 of the front panel 24 located generally between the two pockets 50, 54 is in the same plane as the rim 44. In other embodiments, as shown in FIGS. 1–2, the first pocket 50 and the second pocket 54 are not completely separate. Instead, a smoothly curved transition area 74 exists between the two pockets. It should be appreciated that, in some embodiments, the figural item 56 may extend beyond the second pocket 54 and/or into the first pocket 50.

Although the present invention has been described with reference to certain embodiments thereof, it may be embodied in other specific forms without departing from the essential spirit or attributes thereof. For example, although the polymer material forms a rigid or semi-rigid blister in the embodiment depicted in FIGS. 1–2, shrinkable material or stretch pack material may also be used to contain and hold the product 52 and the figural item 56 in separate pockets. In addition, the rim 44 does not need to correspond to the shape of the backer board 22. The rim 44 could form any shape that allows for a secure connection between the backer board 22 and the front panel 24. This includes, without being limited to, a rim 44 that generally follows the perimeter of the first pocket 50 and/or the second pocket 54.

The embodiments described herein should be considered in all respects as illustrative, not restrictive, and reference should be made to the appended claims for determining the scope of the invention.

What is claimed is:

1. A package for containing a product to be sold, comprising:

(a) a cardboard backer board. defining:

a front surface adapted to receive a first graphical design;

a generally planar rear surface adapted to receive a second graphical design;

a plurality of edges; and a hanging aperture in close proximity to at least one of the plurality of edges;

(b) a generally transparent front panel, at least a portion of which has a three-dimensional structure and a generally planar rim, the rim being generally adjacent to the edges of the backer board and adhesively connected to the front surface of the backer board, wherein the backer board and the three-dimnensional structure cooperate to define a product receiving pocket; and (c) a figural item attached to the backer board, the figural item having a three-dimensional outer presentation surface and a generally planar rim.

2. The package of claim 1, wherein the figural item is attached to the backer board remotely from the product receiving pocket.

3. The package of claim 1, wherein the front panel is substantially continuous.

* * * * *